United States Patent [19]

Pavick

[11] Patent Number: 4,483,232

[45] Date of Patent: Nov. 20, 1984

[54] COMBINATION FOOT STOOL AND PIANO FLOOR PEDAL ACTUATOR

[76] Inventor: Fred Pavick, 2465 W. Balmoral, Chicago, Ill. 60625

[21] Appl. No.: 535,028

[22] Filed: Sep. 23, 1983

[51] Int. Cl.[3] ..... G10C 3/26

[52] U.S. Cl. ..... 84/232

[58] Field of Search ..... 84/230–232, 84/358, 422 R

[56] References Cited

U.S. PATENT DOCUMENTS 502,944 8/1893 Zender ..... 84/232
811,279 1/1906 Creighton et al. ..... 84/232
1,007,980 11/1911 Schreiner ..... 84/232
3,747,464 7/1973 Russell ..... 84/422 R

FOREIGN PATENT DOCUMENTS 25977 2/1884 Fed. Rep. of Germany ..... 84/232
21852 1/1899 United Kingdom ..... 84/230

*Primary Examiner*—Lawrence R. Franklin

[57] ABSTRACT

A foot stool and piano pedal actuator whereby children or short legged persons can comfortably and conveniently sit in a proper address position relative to a piano and have a foot rest together with an auxiliary foot pedal providing an operable touch with a remote piano floor pedal.

1 Claim, 5 Drawing Figures

COMBINATION FOOT STOOL AND PIANO FLOOR PEDAL ACTUATOR

SUMMARY OF THE INVENTION

In the past there has been numerous attempts to produce a structure whereby a short legged piano player could easily actuate the piano floor pedals. None of the prior devices provided the convenience of a stable foot stool permitting full comfortable piano address position for the player, together with an auxiliary piano pedal actuator within operable reach, whereby the player could easily and conveniently actuate the remote piano foot pedals.

The present apparatus includes a foot rest floor member that is readily adjustable through various elevational levels, achieved by a single manual control, without interference with its remote piano pedal actuating system. This actuating system includes auxiliary pedal having an actuating connection with a second pedal assembly that is in turn minutely adjusted into operative contact with the piano floor pedal, whereby the piano pedal may be depressed by remote actuation of the auxiliary pedal.

It is an object of the present invention to not only provide a solid foot stool for use in conjunction with a standard piano keyboard but also to provide a piano floor pedal actuating system whereby a child or short legged person may be properly addressed to the keyboard and piano pedals.

A further object of the invention is to provide a vertically adjustable foot stool readily positioned with respect to a piano keyboard and its associate piano floor foot pedals.

Yet another object of this invention is to provide a minute adjustment means between an auxiliary foot pedal and the piano floor pedal assuring smooth and easy actuation of the latter by the user of the foot stool.

Other objects will appear hereinafter.

BRIEF DESCRIPTION OF THE DRAWINGS

The invention will be best understood by reference to the accompanying drawings which illustrate the preferred mode of embodiment of the inventive concept by which the stated objects of this invention are achieved, and, in which.

GENERAL DESCRIPTION

Figure 1:
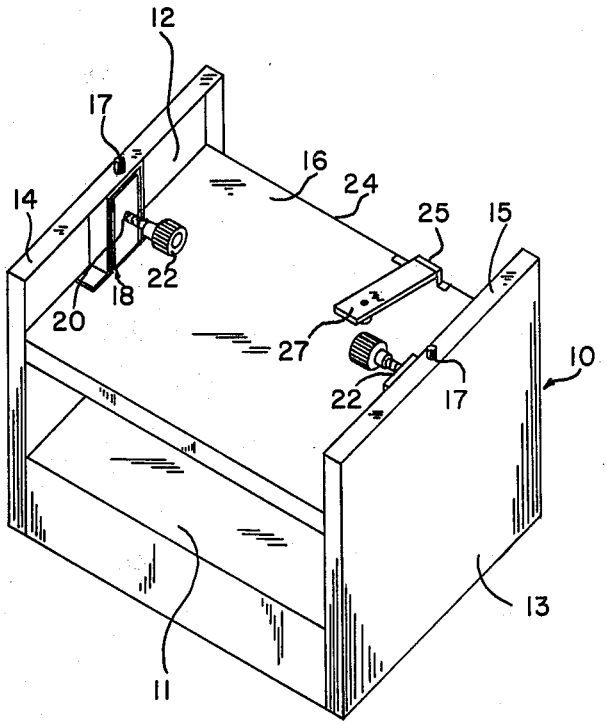
FIG. 1 is a perspective view of the piano foot stool and piano floor pedal actuator.

The foot stool and piano pedal actuator is generally illustrated at 10 in FIG. 1. As such the apparatus provides a raised base 11 which supports vertically extending parallel side walls 12 and 13. The vertical and top edges of the side walls 12 and 13 provide inwardly directing flanges 14 and 15, as seen in FIG. 1.

Positioned within the flanges 14 and 15 is a moveable foot stool or platform 16. Extending parallel to the side walls 12 and 13 and journalled through the top horizontal flanges 14 and 15 thereof and through the base 11 are a pair of guide and support rods 17 for the foot stool 16.

Adjacent to the opposite parallel horizontal side edges of the foot stool 16 and mounted upon the upper surface thereof is a housing 18. This housing presents a vertical wall surface 19 which provides a threaded aperture 20 through which the threaded shank 21 of a locking knob 22 is positioned, as illustrated in FIG. 1.

Figure 3:
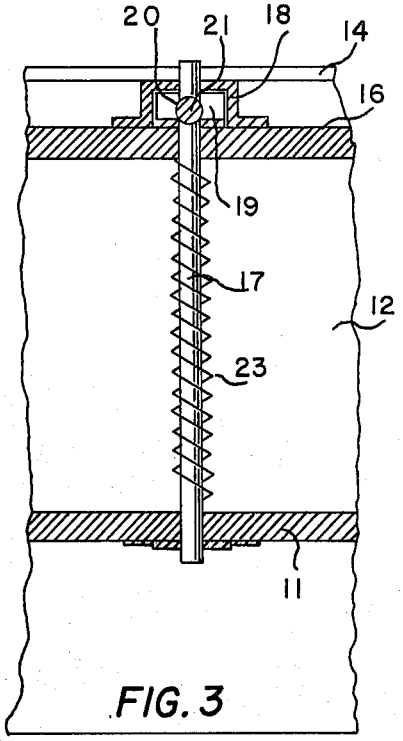
FIG. 3 is a fragmentary side elevational view of one means of vertical adjustment for the foot stool of this invention.

Between the foot stool 16 and the base 11 and encircling the rods 17 is an expansion spring 23. This spring 23 will normally urge the foot stool 16 and the housing 18 into its uppermost position where the latter will engage the under surface of the flanges such as 14 shown in FIG. 3. By this arrangement the user of the apparatus may by rotating the locking knobs 22 disengage the ends of the threaded shank portions 20 from the rods 17. Downward pressure on the stool 16 against the normal expansion of the spring 23 will permit positioning of the foot stool 16 in any desired elevation. When the desired position of the foot stool 16 is reached the knobs 22 are reversibly turned so as to cause their threaded shank portion 20 to bear fixedly against the rods 17 for mounting the stool 16 in such elected horizontal elevation. By the foregoing arrangement, the foot stool 16, when placed in conjunction with a piano bench, can be adjusted to support the feet of any player, regardless of the length of their legs.

Figure 2:
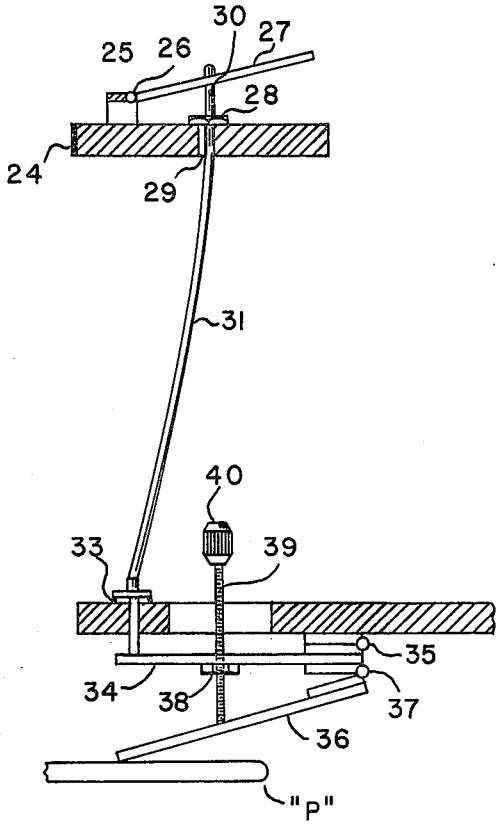
FIG. 2 is a fragmentary detailed sectional view of the piano foot pedal actuating means embodied in this invention.
Figure 4:
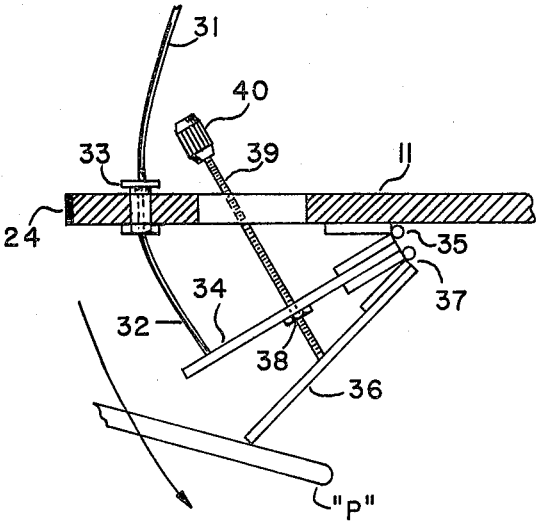
FIG. 4 is a fragmentary detailed sectional view of the piano floor pedal actuating means in a piano pedal actuating position.

As viewed in FIGS. 1, 2, and 4, adjacent to the forward edge 24 of the foot stool 16 there is a generally U-shaped mounting bracket 25. By a pivot pin 26 (see FIG. 2) an auxiliary foot pedal 27 is movably connected to the bracket 25. Connected to the foot pedal 27 and extending through a suitable bushing 28 and opening 29 carried by and formed in the foot stool 16 is one end 30 of a flexible protective actuating cable 31. The opposite end 32 of the actuating cable 31 is journalled through a suitable bushing 33 provided by the base 11 and is connected to one movable plate 34 of a piano pedal actuating mechanism, which by hinge 35 is attached to the base 11.

As viewed in FIGS. 2 and 4 the piano pedal actuating mechanism consists of the plate 34 attached to the underside of the base 11. The mechanism includes a piano pedal contact plate 36 which likewise is hinged as at 37 to the plate 34 for independent pivotal movement relative thereto. The plate 34 on its underside provides a fixed threaded bearing 38 through which the threaded shank 39 of an adjustment screw 40 projects. The free end of the shank 39 bears upon the pedal contact plate 36. Thus by rotation of the adjustment screw 40 its shank 39 will thread through the bearing 38 and contact the pedal contact plate 36 pivoting the same away or toward the first plate 34. This adjustment is necessary to accomodate the spacing variances presented by different located piano pedals "P". By this adjustment the piano pedal contact plate 36 can be adjusted so as to always be in contact with a piano pedal "P".

From the foregoing it is apparent that when the piano player depresses the auxiliary pedal 27 by its foot resting on the foot stool 16 the movement of such pedal 27 will be transmitted through the cable 31 and will pivot the plate 34 as well as the pedal contact plate 36 against, and for the purpose of actuating, a piano pedal "P".

Figure 5:
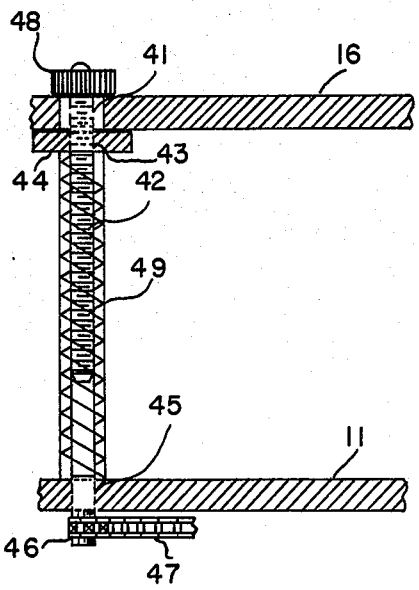
FIG. 5 is a detailed sectional view of a modified means for adjusting elevation of the foot stool of this invention.

Referring to FIG. 5, there is shown a modified form of elevational adjustment for the foot stool 16. In such modified form the platform 16 has an opening 41 through which freely projects a threaded rod 42. The threaded rod 42 is threaded through a threaded aperture 43 provided by a bearing block 44 attached to the underside of the foot stool 16 adjacent the opening 41 formed therein. The bottom end of the threaded rod 42 freely projects through an opening 45 formed in the base 11 and has mounted thereon a sprocket wheel 46 which engages a suitable chain 47. The chain 47 is of a length to extend across the width of the base 11 and encircle a like sprocket carried by an opposite adjustment member, not shown, adjacent the opposite side wall. By this arrangement, when rod 42 is rotated by the knob 48, it will effect vertical movement of the foot stool 16 against normal expansion of a spring 49 which embraces the rod 42 as shown. Thus the user of the device by rotating the knob 48 can effect the adjustment necessary to bring the foot stool 16 to the proper horizontal plane in relation to the user's requirments.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claim.

Having thus described the invention, what I claim as new and desire to secure by Letters Patent is:

1. A combination foot stool and piano pedal actuator comprising:

(a) a stationary horizontally extending elevated base adapted to be positioned over a piano foot pedal, (b) a pair of side walls connected to and extending above and below certain opposite side edges of said base, (c) a movable platform between said side walls above and in parallel relation to said base, (d) means for movably supporting said platform between said side walls for movement through a vertical plane relative to said base, (e) means for releasably locking said platform to said supporting means at any point throughout its vertical length so as to vary the distance between said base and said platform, (f) an auxiliary foot pedal hingedly carried by the top surface of said platform, (g) an actuating plate pivotally carried on the under side of said base, (h) a flexible means connecting said auxiliary foot pedal to said actuation plate for effecting simultaneous movement relative to said platform and said base respectively, (i) a piano pedal contacting plate hinged to said actuating plate and adapted for independent and simultaneous pivotal movement with repect thereto, and (j) an adjusting means extending between said actuating plate and said piano pedal contacting plate for varying the distances therebetween and for effecting pivotal movement of said piano pedal contacting plate in one direction upon simultaneous pivotal movement of said auxiliary foot pedal and said actuating plate for depressing a piano foot pedal.

* * * * *